US007766436B1

(12) United States Patent
Steinkuhl et al.

(10) Patent No.: US 7,766,436 B1
(45) Date of Patent: Aug. 3, 2010

(54) APPLIANCE PANEL WITH OVERLAY PANEL AND A METHOD FOR MOUNTING AN OVERLAY PANEL TO AN APPLIANCE PANEL

(75) Inventors: Allan R. Steinkuhl, Evansville, IN (US); Jason R. Yochum, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 197 days.

(21) Appl. No.: 11/447,632

(22) Filed: Jun. 6, 2006

(51) Int. Cl.
*A47B 95/00* (2006.01)

(52) U.S. Cl. ..... 312/296; 312/204

(58) Field of Classification Search ..... 312/400, 312/401, 405, 405.1, 406, 406.2, 265.5, 326, 312/204, 109, 296, 265.6; 49/400, 401, 402, 49/501; 296/146.7, 39.1
See application file for complete search history.

(56) References Cited

U.S. PATENT DOCUMENTS

| | | | | |
|---|---|---|---|---|
| 2,100,811 | A | 11/1937 | Marshall | |
| 2,720,683 | A * | 10/1955 | Schwenker et al. | 49/496.1 |
| 4,514,021 | A | 4/1985 | Sundermeier et al. | |
| 4,586,762 | A * | 5/1986 | Kennedy et al. | 312/330.1 |
| 5,358,326 | A | 10/1994 | Cherry et al. | |
| 5,487,239 | A * | 1/1996 | Jenkins et al. | 49/498.1 |
| 6,053,585 | A * | 4/2000 | Osen | 312/204 |
| 2003/0173883 | A1* | 9/2003 | Koons | 312/405 |
| 2003/0222547 | A1* | 12/2003 | Trees | 312/204 |
| 2004/0156696 | A1* | 8/2004 | Grosch | 411/378 |

FOREIGN PATENT DOCUMENTS

| | | | |
|---|---|---|---|
| DE | 3304034 | | 9/1984 |
| DE | 19644734 | | 10/1996 |
| EP | 0647821 | | 10/1994 |
| EP | 877215 | | 11/1998 |
| EP | 0878676 | | 11/1998 |
| EP | 1145667 | | 10/2001 |
| EP | 565900 | | 3/2003 |
| FR | 2535960 | | 11/1983 |
| FR | 2702803 | | 3/1994 |
| GB | 2184648 | A * | 7/1987 |
| GB | 2186311 | | 8/1987 |
| JP | 7234067 | * | 9/1995 |
| WO | 03/023298 | | 3/2003 |

* cited by examiner

*Primary Examiner*—Janet M Wilkens
*Assistant Examiner*—Matthew W Ing
(74) *Attorney, Agent, or Firm*—Kirk W. Goodwin; Greer, Burns & Crain Ltd

(57) ABSTRACT

An appliance, appliance panel and a method of assembling an appliance panel are provided in which the appliance panel has an interior side and an exterior side. An overlay panel is positioned on the exterior side of the appliance panel. A fastening device is secured to the overlay panel and extends through the appliance panel at a defined area. A removable and replaceable functional member is attached to the appliance panel and overlies the fastening device at the defined area to prevent the fastening device from being visible during normal use of the appliance.

12 Claims, 1 Drawing Sheet

APPLIANCE PANEL WITH OVERLAY PANEL AND A METHOD FOR MOUNTING AN OVERLAY PANEL TO AN APPLIANCE PANEL

BACKGROUND OF THE INVENTION

The present invention relates to overlay panels mounted on appliances and to methods for mounting such panels.

Appliances, such as refrigeration appliances, typically have a cabinet with a movable panel, such as a door or a drawer, to access the interior space of the appliance. These panels have an interior side which is not visible when the panel is closed and an exterior side which remains visible when the panel is closed. The exterior side of the panel, which may be a metal or plastic material is typically painted, coated or colored to provide an aesthetically pleasing appearance. In some cases, an additional overlay panel is attached to the appliance panel to provide a different appearance or for some other reason, as selected or desired by a consumer of the appliance or by the manufacturer or seller. It is known to attach such overlay panels to the appliance panel via brackets or other support members, such as disclosed in U.S. Pat. No. 5,358,326 at elements 28, 29, 50 and 58 utilizing threaded fasteners for the brackets that remain visible from the exterior of the appliance, detracting from the aesthetic appearance of the appliance. European Patent Application 0 647 821 A1 discloses a refrigeration appliance in which an overlay panel is held onto the door of the appliance utilizing a bracket and threaded fasteners, with cover plates, which remain visible from the exterior of the appliance, being used to hide the threaded fasteners. U.S. Pat. No. 4,514,021 discloses a door for a refrigeration appliance in which the door has an inner door and an outer door. A coupling mechanism is provided between the outer and inner doors and the shell of the appliance such that the outer door is forced to one side and away from the axis of the hinges when the inner door is opened. The outer door is secured to a hinge bracket via threaded fasteners 25 and 27. The coupling mechanism and at least the threaded fastener 27 remains visible both from the top of the appliance when the door is closed and at a back or interior side of the door when the door is opened.

It would be an improvement in the art if an appliance panel were provided wherein an overlay panel could be attached, in a removable and replaceable manner, and wherein the attachment mechanism is not visible when the appliance is normally used, both with the door opened and closed.

SUMMARY OF THE INVENTION

The present invention provides an appliance panel wherein an overlay panel may be attached, in a removable and replaceable manner, and wherein the attachment mechanism is not visible when the appliance is normally used, both with the door opened and closed. The present invention also provides a method of installing such an overlay panel to provide the desired appliance panel and resulting appliance with such a panel.

In an embodiment of the invention, a method of installing an overlay panel onto an appliance panel is provided wherein the appliance panel includes a defined area on an interior side of the appliance panel for receiving a removable and replaceable functional member. The steps of the method include securing a fastening device to the overlay panel and inserting the fastening device through the defined area on the interior side of the appliance panel and through the appliance panel, and attaching the removable and replaceable functional member onto the appliance panel at the defined area to cover the fastening device.

In an embodiment of the invention, the fastening device may be a threaded fastener which may be driven through the appliance panel and into the overlay panel from the interior side of the appliance panel. In an embodiment of the invention, the threaded fastener includes a self drilling or thread cutting tip and is driven through the appliance panel and into the overlay panel without first providing a pilot hole.

In an embodiment of the invention, the appliance panel is part of a door or a drawer of a refrigeration appliance.

In an embodiment of the invention, the defined area may be a recess, such as a gasket groove which extends in a continuous manner around the interior side of the appliance panel.

In an embodiment of the invention, the removable and replaceable member may be a gasket which may be secured in the gasket groove with an adhesive.

These and other features and advantages of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENT

The present invention relates to a method for attaching an overlay panel onto an appliance panel and to the resulting appliance and appliance panel. The present invention has applicability to a wide range of appliances and configurations. In order to describe the invention, an embodiment of the invention relating to a refrigeration appliance is disclosed, however, the present invention should not be limited to use in refrigeration appliances, and may also apply to other types of appliances, such as ovens, stoves, dishwashers, dryers, washers, and other common household, commercial and industrial appliances.

Figure 1:
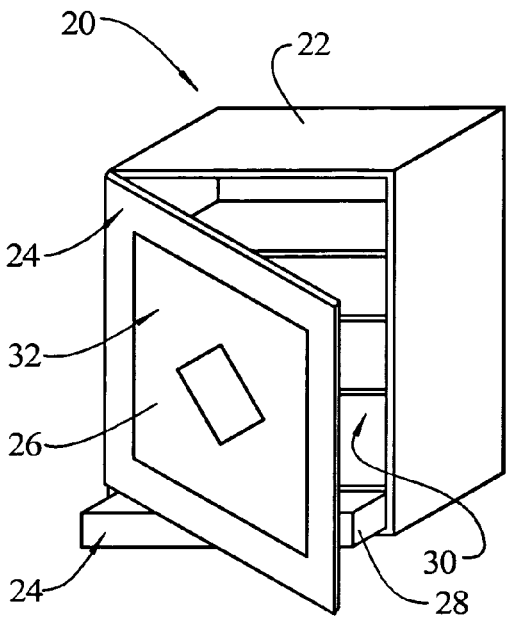
FIG. 1 is a front perspective view of a refrigeration appliance in which the present invention may be embodied with openable panels in the form of a door and a drawer.

An appliance 20 in which the present invention may be utilized is shown in FIG. 1, in the form of a refrigeration appliance. Such an appliance 20 typically includes a cabinet 22 having one or more appliance panels 24, such as those which are openable and form a part of a door 26 or a drawer 28. Panels which are openable typically provide access to an interior space 30 of the appliance, such as a refrigerated space in the case of a refrigeration appliance. The appliance panel 24 is shown as having an attached overlay panel 32 which is sometimes provided to enhance or change an aesthetic appearance of the appliance panel. Such overlay panel 32 may be made of wood, with a stained, painted or natural finish, and sometimes having surface features to give the appearance of a raised panel for example, or may be made of plastic or composite materials with molded features and coloring, or may be made of metal with a shiny, brushed or painted surface. In other cases, the overlay panel 32 may be made of stone, such as granite, or may be a combination of materials.

Figure 2:
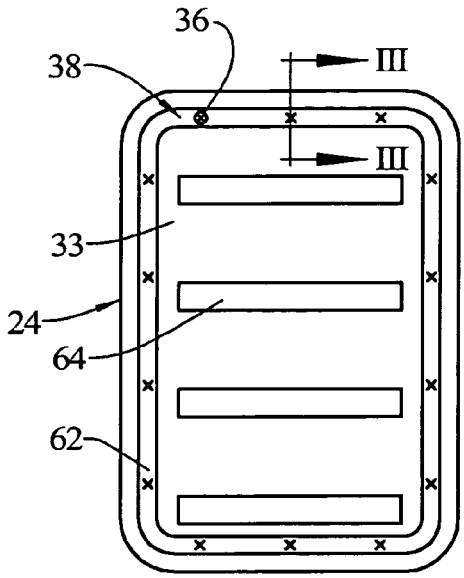
FIG. 2 is an elevational view of an interior side of a panel of the appliance of FIG. 1.
Figure 3:
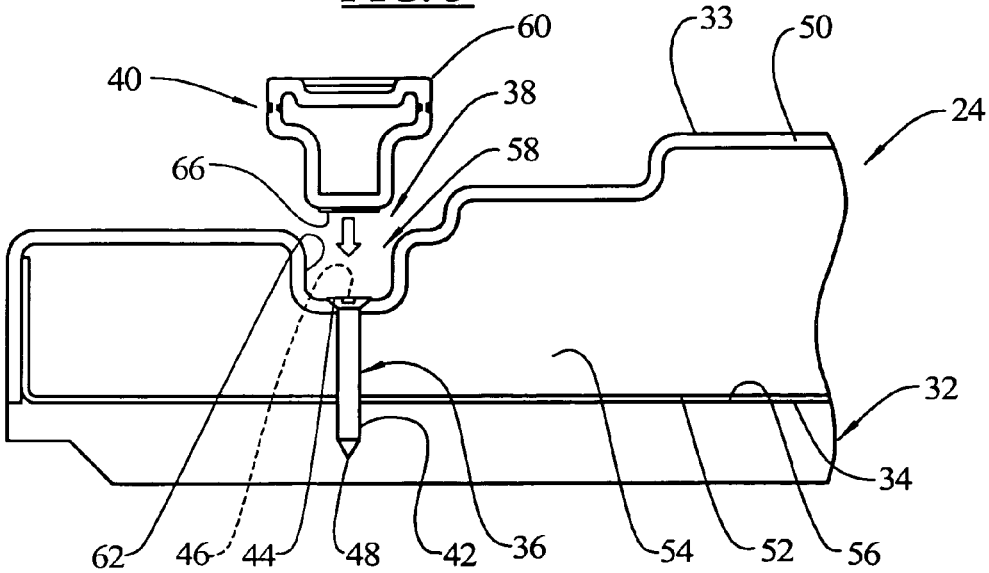
FIG. 3 is a side sectional view of a portion of the appliance panel and an overlay panel taken generally along the line III-III in FIG. 2.

FIG. 2 illustrates an elevational view of the appliance panel 24, and shows an interior side 33 of the appliance panel. FIG. 3 illustrates a sectional view of the appliance panel 24 of FIG. 2, through a section taken generally along the line III-III, and also shows the overlay panel 32 in relationship to the appliance panel.

The overlay panel 32 is positioned on an exterior side 34 of the appliance panel 24, and could be sized and arranged to completely overlie the appliance panel, such that all of the edges of the overlay panel and the appliance panel are flush. Alternatively one or more of the edges of the overlay panel could be spaced inwardly or outwardly of a corresponding edge of the appliance panel, as desired for the particular aesthetic appearance to be achieved. A fastening device 36 is secured to the overlay panel 32 and extends through the appliance panel 24 at a defined area 38. The number and placement of the fastening devices 36 will be dependent upon the size and weight of the overlay panel 32, as well as on the construction of the fastening device itself.

In an embodiment, such as illustrated, the fastening device 36 may comprise a threaded fastener, such as a screw 42 with a head 44 having a recess 46 therein for receiving a driving tool, such as a screwdriver. The screw 42 may be provided with a tip 48 such as a self drilling tip or a thread cutting tip so that the screw may be driven through the appliance panel 24 and into the overlay panel 32 without first providing a pilot hole for the screw. In other embodiments, the self drilling or thread cutting tip 48 may not be provided on the screw 42, and a pilot hole or guide hole may be provided in the appliance panel 24 and optionally also in the overlay panel 32. The construction of the appliance panel 24 may determine whether a pilot hole or a guide hole is required or desired. In some appliance panels 24, such as illustrated in FIG. 3, the panel itself is made of a thin material, such as a plastic inner liner 50 and a sheet metal shell 52, with a foamed insulation layer 54 in between. With such a construction, a self drilling screw may easily penetrate the material. In other constructions, denser or harder materials may be employed, making the use of a pilot or guide hole desirable or necessary.

In an embodiment, the fastening device 36 extends into but not all the way through the overlay panel 32. In other embodiments, the fastening device 36 may be secured to a rear face 56 of the overlay panel 32, such as by an adhesive or other means, or the fastening device may extend completely through the overlay panel and may extend into other components.

In an embodiment, the defined area 38 may comprises a recess 58 in the interior side 33 of the appliance panel 24. In other embodiments, the defined area 38 may be an area between various components on the appliance panel 24, such as between two walls, or between two ridges, or delineated in some other manner, such as by a surface marking, etc. In still other embodiments, the defined area 38 may simply be an area in a portion of the appliance panel 24 where the removable and replaceable functional member 40 may be placed, or may overlie, and no visible indication of the area need be provided.

A removable and replaceable functional member 40 is attached to the appliance panel 24 and overlies the fastening device 36 at the defined area 38. In an embodiment, the functional member 40 may comprise a gasket 60 and the recess 58 may comprise a gasket groove 62 extending in a continuous manner around the interior side 33 of the appliance panel 24. In this embodiment, the fastening device 36 or screw 42 may be driven through the gasket groove 62, through the appliance panel 24, and into the overlay panel 32 to securely attach the overlay panel to the appliance panel. The head 44 of the screw 42 will be covered by the gasket 60 when it is reinserted into the gasket groove 62, thereby hiding the fastening mechanism used to attach the overlay panel 32 to the appliance panel 24, and enhancing the visual appearance of the appliance 20 and appliance panel.

The term removable and replaceable functional member is meant to describe a component that primarily provides a useful function, other than primarily being provided for an aesthetic purpose. For example, a cover plate or similar structure is considered to have a aesthetic primary purpose of hiding that which it covers. On the other hand, the illustrated gasket 60 has a functional primary purpose of sealing a gap between the appliance panel 24 and the appliance cabinet 22 when the panel is in the closed position. Other types of functional members associated with an appliance panel 24 might include shelf assemblies 64 (FIG. 2), lighting assemblies, control assemblies, mounting brackets, and similar structures, not limited to this list. The removable and replaceable aspect of the functional member 40 is meant to describe a feature whereby the member can be removed, without destroying the member, such that it could be reattached to the appliance panel 24, if desired, or replaced with another member for various reasons.

In the embodiment where the removable and replaceable functional member 40 is the gasket 60, the gasket may be secured in the gasket groove 62 by a friction fit, interfering detents, fingers, or other known mechanical attachments, not requiring separate fasteners, or with an adhesive 66, such as a releasable adhesive that remains tacky.

The method for carrying out the invention of installing the overlay panel 32 onto the appliance panel 24, wherein the appliance panel includes the defined area 38 on the interior side 33 of the appliance panel for receiving the removable and replaceable functional member 40, comprises the steps of:

securing the fastening device 36 to the overlay panel 32 and inserting the fastening device through the defined area 38 on the interior side 33 of the appliance panel 24 and through the appliance panel, and attaching the removable and replaceable functional member 40 onto the appliance panel at the defined area to cover the fastening device.

In the embodiment where the fastening device 36 comprises a threaded fastener, the step of securing and inserting may comprise driving the threaded fastener from the interior side 33 of the appliance panel 24 at the defined area 38 through the appliance panel and into the overlay panel 32.

In an embodiment, the step of driving comprises driving the threaded fastener 36 into but not all the way through the overlay panel 32.

In an embodiment wherein the threaded fastener 36 includes a self drilling tip or a thread cutting tip 48, the step of driving comprises driving the threaded fastener through the appliance panel 24 and into the overlay panel 32 without first providing a pilot hole.

In an embodiment, prior to the step of driving the threaded fastener 36 through the appliance panel 24, there is provided a step of forming a pilot hole in at least the appliance panel, and perhaps in the overlay panel 32 as well.

In an embodiment, wherein the defined area 38 on the interior side 33 of the appliance panel 24 comprises a recess 58, the step of attaching may comprise inserting a portion of the functional member 40 into the recess.

In an embodiment wherein the functional member 40 comprises a gasket 60 and the recess 58 comprises a gasket groove 62 which extends in a continuous manner around the interior side 33 of the appliance panel 24, the step of attaching may comprise inserting a portion of the gasket into the groove in a complete circuit around the interior side of the appliance panel.

In an embodiment, the gasket 60 may be secured in the gasket groove 62 with an adhesive 66, such as a releasable adhesive that remains tacky.

In an embodiment, wherein the appliance 20 is assembled without the overlay panel 32 in place, prior to the step of driving the fastening device 36 into the appliance panel 24, a step is provided of removing the functional member 40 from the defined area 38 on the interior side 33 of the appliance panel.

The result of the present invention is that the overlay panel 32 may be attached to the appliance panel 24 in a secure manner and the attaching mechanism in the form of the fastening device 36, following replacement of the functional member 40, will be hidden from view, enhancing the appearance of the appliance 20 and the appliance panel.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of installing an overlay panel onto an appliance panel having an interior side formed by a plastic inner liner and an exterior side formed by a sheet metal shell, with an insulation layer in between, wherein said appliance panel includes a gasket groove with side walls and a bottom wall recessed relative to an area of said plastic inner liner adjacent to said gasket groove, said gasket groove extending in a continuous manner around said plastic inner liner for receiving a removable and replaceable gasket, comprising the steps:

abutting said overlay panel directly against said exterior side of said appliance panel;

securing a threaded fastener to said overlay panel by inserting and driving said threaded fastener from said bottom wall of said gasket groove of said appliance panel and through said appliance panel and into but not all the way through said overlay panel; and attaching said removable and replaceable gasket onto said appliance panel by inserting a portion of said gasket into said gasket groove in a complete circuit around said plastic inner liner to cover said threaded fastener after said threaded fastener has been inserted through said appliance panel and secured to said overlay panel.

2. A method according to claim 1, wherein said threaded fastener includes a self drilling tip and said step of driving comprises driving said threaded fastener through said appliance panel and into said overlay panel without first providing a pilot hole.

3. A method according to claim 1, wherein prior to said step of driving said threaded fastener through said appliance panel, there is provided a step of forming a pilot hole in at least said appliance panel.

4. A method according to claim 3, wherein said step of forming a pilot hole further comprises forming said pilot hole in said overlay panel.

5. A method according to claim 1, including the further step of securing said gasket in said gasket groove with a releasable adhesive.

6. A method according to claim 1, wherein prior to said step of driving said threaded fastener into said gasket groove, a step is provided of removing said gasket from said gasket groove.

7. An appliance panel assembly comprising:

an appliance panel having an interior side formed by a plastic inner liner and an exterior side formed by a sheet metal shell, with an insulation layer in between;

an overlay panel positioned directly in contact with said exterior side of said appliance panel;

said plastic inner liner including a gasket groove having opposed side walls and a bottom wall, said gasket groove being recessed relative to an area adjacent to said gasket groove, and said gasket groove extending in a continuous manner around said plastic inner liner, a threaded fastener extending through said appliance panel at said bottom wall of said gasket groove of said plastic inner liner and into but not through said overlay panel; and a gasket attached to said plastic inner liner of said appliance panel in a manner permitting said gasket to be non-destructively removed and replaced on said plastic inner liner and overlying said threaded fastener at said gasket groove.

8. An appliance panel assembly according to claim 7, wherein said gasket is secured in said gasket groove with a releasable adhesive.

9. A refrigeration appliance including a door and an appliance panel assembly forming a part of said door of said refrigeration appliance, comprising:

said appliance panel having an interior side formed by a plastic inner liner and an exterior side formed by a sheet metal shell, with an insulation layer in between;

an overlay panel positioned directly in contact with said exterior side of said appliance panel;

said plastic inner liner including a gasket groove having opposed side walls and a bottom wall, said gasket groove being recessed relative to an area adjacent to said gasket groove, and said gasket groove extending in a continuous manner around said plastic inner liner, a threaded fastener extending through said appliance panel at said bottom wall of said gasket groove of said plastic inner liner and into but not through said overlay panel; and a gasket attached to said plastic inner liner of said appliance panel in a manner permitting said gasket to be non-destructively removed and replaced on said plastic inner liner and overlying said threaded fastener at said gasket groove.

10. A refrigeration appliance including a drawer and an appliance panel forming part of said drawer, comprising:

said appliance panel having an interior side formed by a plastic inner liner and an exterior side formed by a sheet metal shell, with an insulation layer in between;

an overlay panel positioned directly in contact with said exterior side of said appliance panel;

said plastic inner liner including a gasket groove having opposed side walls and a bottom wall, said gasket groove being recessed relative to an area adjacent to said gasket groove, and said gasket groove extending in a continuous manner around said plastic inner liner, a threaded fastener extending through said appliance panel at said bottom wall of said gasket groove of said plastic inner liner and into but not through said overlay panel; and a gasket attached to said plastic inner liner of said appliance panel in a manner permitting said gasket to be non-destructively removed and replaced on said plastic inner liner and overlying said threaded fastener at said gasket groove.

11. An appliance, comprising:

an appliance panel openable relative to a remainder of said appliance and having an interior side formed by a plastic interior liner and an exterior side formed by a sheet metal shell, with an insulation layer in between;

an overlay panel positioned directly in contact with said exterior side of said appliance panel;

said plastic inner liner including a gasket groove having opposed side walls and a bottom wall, said gasket groove being recessed relative to an area adjacent to said gasket groove, and said gasket groove extending in a continuous manner around said plastic inner liner, a threaded fastener extending through said appliance panel at said bottom wall of said gasket groove of said plastic inner liner and into but not through said overlay panel; and a gasket attached to said plastic inner liner of said appliance panel in a manner permitting said gasket to be non-destructively removed and replaced on said plastic inner liner and overlying said threaded fastener at said gasket groove.

12. A refrigeration appliance, comprising:

an appliance panel openable relative to a remainder of said appliance to provide access to a refrigerated space within said refrigeration appliance, said appliance panel having an interior side and an exterior side;

said interior side of said appliance panel comprising a plastic interior liner with a portion of said liner comprising a planar surface, said exterior side comprising a sheet metal shell, and including a foamed insulation layer positioned between said interior side and said exterior side;

a gasket groove in the form of a depression in said planar surface of the plastic interior lining forming said interior side of said appliance panel having opposed side walls and a bottom wall;

an overlay panel positioned directly in contact with said exterior side of said appliance panel with a back side of said overlay panel engaged against said exterior side of said appliance panel;

a threaded fastener extending through said bottom wall of said gasket groove and said appliance panel; and into said back side of said overlay panel without extending all the way through said overlay panel; and a gasket received in said gasket groove in a manner permitting said gasket to be non-destructively removed and replaced and covering said threaded fastener.

* * * * *